US007132616B1

(12) United States Patent
Radosavljevic et al.

(10) Patent No.: US 7,132,616 B1
(45) Date of Patent: Nov. 7, 2006

(54) ELECTRICAL WIRING DEVICE WITH ARC MINIMIZER SWITCH ASSEMBLY AND METHOD

(75) Inventors: Dejan Radosavljevic, Syracuse, NY (US); Richard Weeks, Little York, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 11/058,865

(22) Filed: Feb. 16, 2005

Related U.S. Application Data

(63) Continuation-in-part of application No. 10/994,662, filed on Nov. 22, 2004.

(60) Provisional application No. 60/553,795, filed on Mar. 16, 2004.

(51) Int. Cl.
*H01H 21/00* (2006.01)

(52) U.S. Cl. ..... 200/553; 200/339

(58) Field of Classification Search ..... 200/6 B, 200/16 C, 315, 339, 553, 557–560
See application file for complete search history.

(56) References Cited

U.S. PATENT DOCUMENTS

| | | | | |
|---|---|---|---|---|
| 3,770,920 | A | 11/1973 | Poliak | |
| 4,115,673 | A * | 9/1978 | Smith | 200/315 |
| 4,221,941 | A * | 9/1980 | Genovese | 200/457 |
| 4,321,442 | A * | 3/1982 | Tanaka et al. | 200/308 |
| 4,870,230 | A * | 9/1989 | Osika et al. | 200/6 R |
| 5,041,706 | A * | 8/1991 | Osika et al. | 200/296 |
| 5,045,648 | A * | 9/1991 | Fogleman, Sr. | 200/43.16 |
| 5,047,598 | A * | 9/1991 | Osika et al. | 200/43.16 |
| 5,064,977 | A * | 11/1991 | Fierro | 200/293 |
| 5,712,450 | A * | 1/1998 | Chan et al. | 174/66 |
| 5,810,109 | A * | 9/1998 | Chu | 200/308 |
| 5,950,812 | A | 9/1999 | Tanacan et al. | |
| 5,982,269 | A * | 11/1999 | Sorenson | 337/380 |
| 6,175,090 | B1 * | 1/2001 | Blossfeld | 200/558 |
| 6,444,930 | B1 * | 9/2002 | MacDonald et al. | 200/302.3 |
| 6,459,060 | B1 * | 10/2002 | Bartok | 200/553 |
| 6,545,239 | B1 | 4/2003 | Spedale et al. | |

(Continued)

FOREIGN PATENT DOCUMENTS

GB 2153592 * 8/1985

*Primary Examiner*—Michael Friedhofer
*Assistant Examiner*—Lisa Klaus
(74) *Attorney, Agent, or Firm*—William J. Greener; Bond, Schoeneck & King PLLC

(57) ABSTRACT

An electrical wiring device configured to be disposed in an electrical distribution system including a power source for providing power to a load, including a compact switch assembly. The compact switch assembly includes a rocker assembly, a fixed contact assembly and a moveable contact assembly. By design and interaction between surfaces of the rocker assembly and the moveable contact assembly, permanent switch contact closure due to contact arc welding is avoided. A pivot member including a (moveable) contact is opened to a first contact separation distance within a given time and then to a second contact separation distance via user supplied force to a user accessible surface. A combination device is also disclosed including a circuit interrupter configured to provide power to a portion of the electrical distribution system in the closed contact position and to interrupt power from a portion of the electrical distribution system in the open contact position in response to a predetermined fault condition in the electrical distribution system. A method for opening a set of closed switch contacts in a switch assembly of an electrical device configured to provide the rated current of an AC electrical distribution system to a load is further disclosed.

32 Claims, 4 Drawing Sheets

U.S. PATENT DOCUMENTS 6,573,466 B1 * 6/2003 Rapp et al. ..... 200/302.3
6,590,175 B1 * 7/2003 Lam ..... 200/315
6,600,122 B1 * 7/2003 Czarnecki et al. ..... 200/553
6,797,905 B1 9/2004 Wang et al.
6,930,269 B1 * 8/2005 Lee et al. ..... 200/553
6,940,029 B1 * 9/2005 Wang et al. ..... 200/315

* cited by examiner

ELECTRICAL WIRING DEVICE WITH ARC MINIMIZER SWITCH ASSEMBLY AND METHOD

RELATED APPLICATION DATA

This application is a continuation-in-part of U.S. Ser. No. 10/994,662 filed on Nov. 22, 2004, which itself claims priority to U.S. Provisional Application Ser. No. 60/553,795 filed on Mar. 16, 2004, and claims the benefit of priority to these prior applications under 35 U.S.C. §119 and §120. These applications are both herein incorporated by reference in their entireties.

FIELD OF THE INVENTION

Embodiments of the invention generally relate to the field of electrical wiring devices and, more particularly, to an electrical wiring device including a switch assembly designed to eliminate contact arcing and welding, and to a method for opening a set of closed switch contacts.

BACKGROUND OF THE INVENTION

The switch component of an electrical wiring device typically includes a user accessible switch arm, rocker paddle, push button, touch pad, etc. ("switching surface"), a lever arm or suitable linkage attached to the backside of the switching surface, and a line side contact that can be connected/disconnected from a load side contact via operation of the switching surface by the user. A common single switch device for activating a remote receptacle or light, for example, typically presents the switching surface in the center of the electrical wiring device having an on/off motion along the longitudinal axis of the device. When two switches are presented on a single electrical wiring device, or a switch and a receptacle, for example, are presented on a single device, the switching surface(s) operates in a direction that is transverse to the length of the device. Accordingly, switch placement, orientation, size and ergonomics become considerations in modern, functional and aesthetic switch design.

Safety is a further major consideration in the design and operation of electrical wiring devices. For example, a receptacle disposed in an electrical distribution system may supply power through a user attachable plug to a load or to other receptacles. In certain environments where a greater likelihood for an electrical shock hazard exists, such as in a residential bathroom or kitchen, for example, the receptacle may include a circuit protection component, e.g., a ground fault circuit interrupter (GFCI). However, the use of wiring devices having a circuit protection component or capability is in no way limited to this exemplary environment. GFCIs have been known for many years. Their intended purpose is to protect the electrical power user from electrocution when a hazardous ground fault condition is present. Ground fault conditions are an unintended current path from the line conductor having faulty or damaged insulation to ground. The shock hazard occurs when someone contacts ground and the line conductor at the same time. A fire hazard may occur if the ground fault current results in sufficient heating to ignite nearby combustibles. GFCIs configured to prevent fire but not necessarily protect a user from electrocution are known as ground fault equipment protectors (GFEPs.)

Other known protective devices include arc fault circuit interrupters (AFCIs). Their intended purpose is to protect the electrical power user from fire when a hazardous arcing condition is present. Hazardous arc fault conditions (known as series arc faults) may result from a poor electrical connection in the electrical distribution system supplying power to the load. Hazardous arcing conditions (known as parallel arc faults) may occur between a line to line conductor, line to neutral conductor, or line to ground conductor, due to faulty or damaged insulation. The heat associated with the arc fault condition may be sufficient to ignite nearby combustibles.

Known protective devices such as GFCIs, GFEPs, AFCIs or combinations of such devices are configured to protect an electrical distribution system from at least one fault condition. Such devices are typically provided with line terminals for coupling to the supply voltage of the electrical distribution system, and load terminals coupled to the protected portion of the system and a circuit interrupter for disconnection of the load terminals from the line terminals. Load terminals may include plug receptacles for electrical connection of a user attachable load through a plug. Load terminals may include feed-through terminals for attachment to other receptacles. The protective device may be provided with a sensor for sensing the fault, a detector for establishing if the sensed signal represents a true hazardous fault, as opposed to electrical noise, and a switch responsive to the detector sensor, wherein the circuit interrupter comprising the contacts of a relay or trip mechanism are operated by a solenoid responsive to the switch to disconnect the load terminals from the line terminals. The disconnection is also known as tripping. A power supply may be required to furnish power to the sensor, detector, switch or solenoid.

One disadvantage of known combination devices, herein illustrated as a switch in combination with a protection component, is that the user accessible switch toggles in a motion that is parallel to the minor (latitudinal) axis of the device. The user of the device does not find such rocking motion to be ergonomic. Another disadvantage is that such rocking motion is not consistent with other wiring devices whose rocking motion is perpendicular to the minor axis of the device. Another disadvantage of known combination devices is that the user accessible switch portion of the combination device has been limited in number to a single switch.

Another disadvantage of known switch assemblies and combination devices is that the user accessible switch portion may fail to open because the switch contacts permanently remain in the closed position. Such permanent switch closure may occur for the following reasons: The contacts of the switch erode during opening and closing actuations until the contacts metallurgically bond (weld) together. Such erosion is caused by electrical arcing that occurs when the switch is called upon to make or break load current. Arcing during contact mating (contact closure) occurs in the following manner. At the moment of closure one contact strikes the other. Load current is established, but the striking motion causes the contacts to momentarily repel apart (known as contact bounce.) Even though the contacts have separated, load current continues by way of an electrical arc. The temperature of the arc is greater than the melting point of the contact material, causing contact material to melt. The contacts reclose after the bounce energy has dissipated, at which time the electrical arc extinguishes. However, when the contacts reclose, there is a layer of molten contact material between the two contacts that solidifies once the contacts are closed and there is no longer heat generated by the arc. If the bounce is severe enough, the resulting molten material is sufficient to permanently join the contacts together, that is, the switch mechanism is incapable of breaking the weld connection. During contact break (contact opening), load current does not immediately stop flowing the moment that the contacts open. For DC electrical distribution systems, an electrical arc is generated when the contacts open that continues until the contacts have become sufficiently separated from each other. For AC electrical distribution systems, the arc continues until a zero-crossing in the load current occurs or until the contacts become sufficiently separated, whichever happens first. The arc energy during contact opening roughens the surfaces of the contacts that mate with each other during the next closing operation, which exacerbates welding due to contact bounce. In general, the amount of heat generated by an arc increases as the distance between the contacts during the arcing event increases. Another cause of contact erosion includes mechanical abrasion of the contacts during repeated opening and closing operations. Permanent switch closure can also result from contaminants in the vicinity of the switch. Such contaminants can cause the switch contacts to corrode together. Also, contaminants of a particulate nature can impede the motion of the moving parts in the switch assembly, thus preventing the opening of the switch contacts.

In view of the foregoing and other reasons that will be recognized by those skilled in the art, the inventors have recognized a need to provide a compact switch assembly for use in an electrical wiring device that is functional and ergonomic. There is also a recognized need for a combination device (i.e., circuit interrupter and one or more switch assemblies) that is ergonomic and convenient to use. There is a further recognized need for a switch that can be opened and closed reliably under expected use conditions.

SUMMARY OF THE INVENTION

Embodiments of the invention are directed to an electrical wiring device including a switch assembly and to an electrical wiring device including one or more of the switch assemblies in combination with a circuit protection component.

A particular embodiment of the invention is directed to an electrical wiring device configured to be disposed in an electrical distribution system including a power source for providing power to a load. The device includes a compact switch assembly comprising a rocker assembly having a user accessible surface responsive to an applied force, a fixed contact assembly having a fixed switch contact and a terminal, and a moveable contact assembly for effecting an open contact position and a closed contact position. The moveable contact assembly includes a pivot member having a lever arm portion and an opposing contact end with a contact. In an aspect, the pivot member has a curved portion intermediate the lever arm portion and the contact end. The pivot member is substantially inflexible in response to any mechanical force applied to operate the switch assembly. By means of the shape and rigidity of the pivot member and the cooperative engagement of selective surfaces of the rocker assembly with the pivot member upon actuation of the user accessible surface, the fixed contact and the pivot member (moveable) contact can be moved from the closed contact position to the open contact position in multiple steps in such a manner that the switch contacts will open, minimizing contact arcing that could otherwise result in a welded contact condition. The pivot member has an operational direction of motion the same as the direction of operational motion of the rocker assembly. In an aspect, the open contact position comprises a first contact separation distance in a first step and a greater second contact separation distance in a further step in response to a typical force applied to the user accessible surface in the operation of the switch. In an aspect, the electrical distribution system is an alternating current (AC) system. In a particular aspect, the pivot member is moved from the closed contact position to no more than the first contact separation distance within a half cycle duration of the current to a load connected to the device. In an aspect, the switch assembly has an operational current handling capacity of 15 amperes (A) or greater. In an aspect, the electrical wiring device includes two or more independent rocker assemblies and corresponding switch assemblies. In an aspect, all of the multiple fixed contacts are located on a common member having a single terminal connectable to a line or a load. In an aspect, the switches are single pole switches.

Another embodiment of the invention is directed to an electrical device as recited in the embodiment immediately above and according to its various aspects, further including a circuit interrupter configured to provide power to a portion of the electrical distribution system in the closed contact position and to interrupt power from a portion of the electrical distribution system in the open contact position in response to a predetermined fault condition in the electrical distribution system. In an aspect, the predetermined fault condition includes a ground fault condition. In an aspect, the predetermined fault condition includes an arc fault condition.

Another embodiment of the invention is directed to a method for opening a set of closed switch contacts in a switch assembly of an electrical device configured to provide the rated current of an AC electrical distribution system to a load. In an aspect, the method involves providing a user accessible surface to move at least one of the contacts of the set of contacts through a progressive plurality of steps from a closed contact position to an open contact position. In an aspect, the progressive steps include applying a force to the user accessible surface so as to urge the switch contacts to separate from each other, continuing to apply force to the user accessible surface so as to separate the contacts to a first contact separation distance and continuing to apply force to the user accessible surface so as to separate the contacts to a second contact separation distance. According to an aspect, applying force to the user accessible surface provides a shearing force or a torque against the closed contacts that is tangentially oriented with respect to the contact surfaces. According to an aspect, the method involves separating the contacts to the first contact separation distance within an half cycle of the current to a load connected to the device.

In each of the embodiments referred to above, the power source may be a hot line or a hot load. In each of the embodiments referred to above, the electrical distribution system is particularly rated at a current of 15 A or greater.

The foregoing and other objects, features, and advantages of embodiments of the present invention will be apparent from the following detailed description of the preferred embodiments, which makes reference to several drawing figures.

DETAILED DESCRIPTION OF A PREFERRED EMBODIMENT OF THE INVENTION

A particular embodiment of the invention is directed to an electrical wiring device configured to be disposed in an electrical distribution system including a power source for providing power to a load. The device includes a compact switch assembly. Although the components, design and principles of operation of the switch apply to a single switch, it will be understood that the description is equally applicable to two or more switches adjacently disposed in a housing.

FIGS. 1 through 4 illustrate the operative features of a compact switch assembly 10 according to an embodiment of the invention. The switch assembly is incorporated in an electrical wiring device, as illustrated by example as device 500 in FIG. 5, intended to be disposed in an electrical distribution system (not shown).

Figure 1:
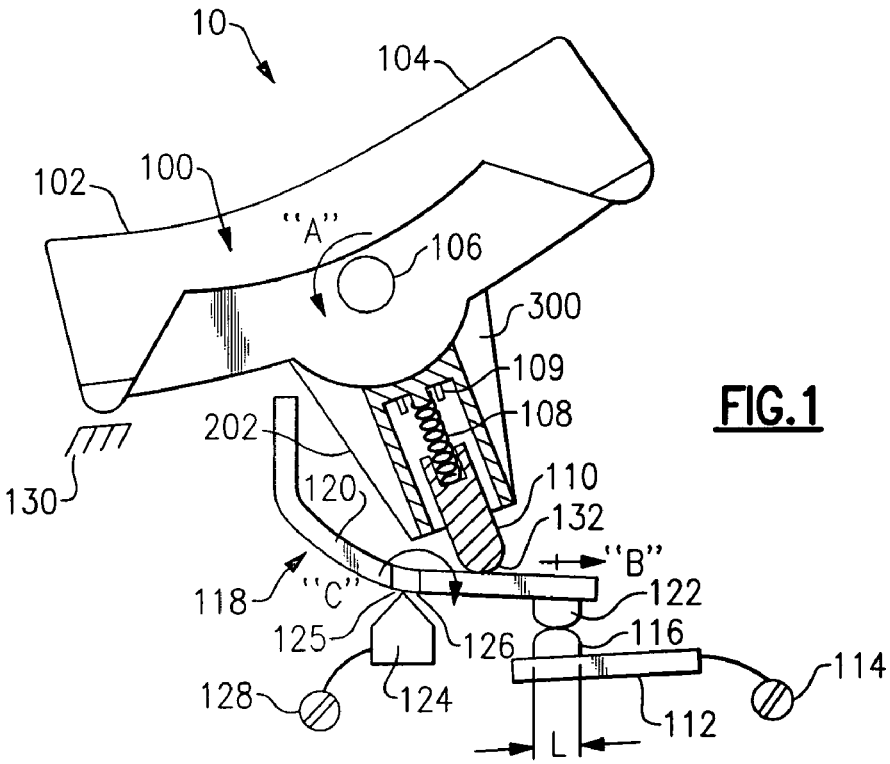
FIGS. 1–4 are diagrammatic cross sectional views of a rocker arm assembly and compact switch assembly in various stages from a closed contact position to an open contact position according to an embodiment of the invention.
Figure 2:
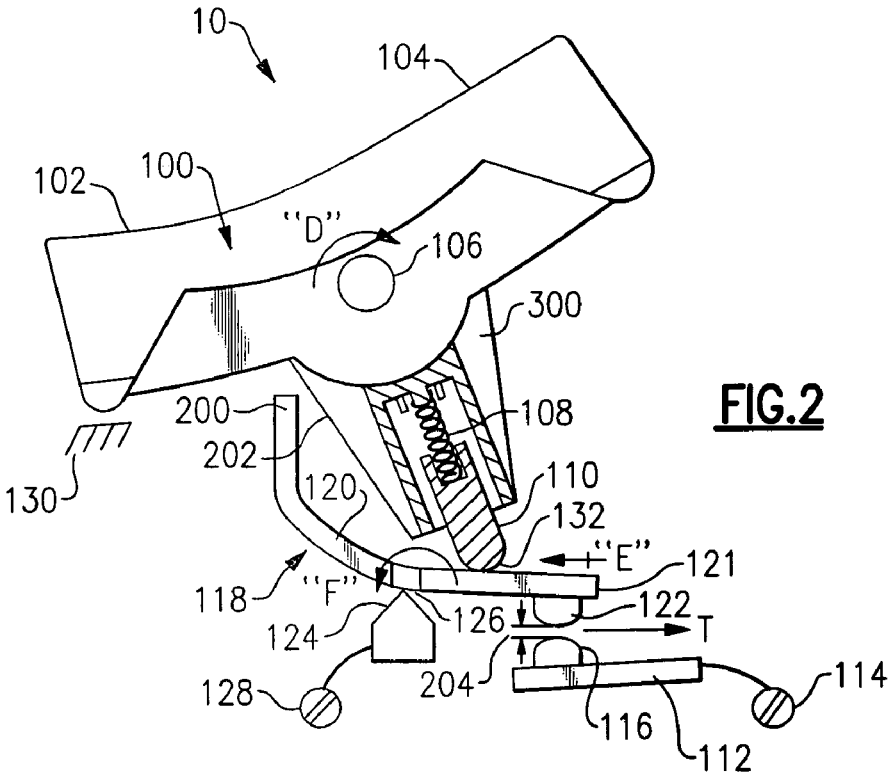

Referring to FIGS. 1 and 2, the switch assembly 10 is shown in the closed contact position. The switch assembly includes a rocker assembly 100 having a user accessible surface 104 for actuation in response to a user applied force for rotating the rocker assembly about a pivot point 106. Pivot point 106 is referenced to the housing of the wiring device (not shown). Rocker assembly 100 includes a rocker arm member 300 extending transversely to the surface 104 from an underside of the assembly. The rocker arm member has an inclined striking surface 202. The arm member 300 has a cavity bore in its center and houses a spring 108 that is secured at an end thereof to a protrusion 109 at the base of the cavity by an interference fit. The other end of the spring is attached to a post 110 also via an interference fit. The post is thus resiliently disposed in the cavity of the arm member. The distal end of the post 110 is tapered to form an actuation surface 132.

The switch assembly 10 also includes a fixed contact assembly 112 having a fixed switch contact 116 and a terminal 114. The switch assembly 10 further includes a moveable contact assembly 118 including a pivot member 120 rotatably mounted on a fulcrum member 124, which is connected to a terminal 128. The pivot member 120 has a lever arm end 200 and a contact end 121 having electrically connected (movable) contact 122. In the illustrated aspect, the pivot member has a curved portion 118 adjacent the lever arm end 200 and a positioning feature 126 to hold the pivot member in a spaced, pivotable relationship to fulcrum member 124. Fulcrum 124 is also referenced to the housing of the wiring device. Fulcrum 124 electrically connects pivot member 120 to terminal 128. The electrical connection may be made by way of a knife edge 125 whose length corresponds to a substantial portion of the width of pivot member 120. Knife edge 125 is configured to distribute heat generated by the electrical connection.

The force of spring 108 urges the actuation surface 132 of post 110 to be in constant contact with the surface of pivot member 120. When the rocker assembly is in a position of contact with stop 130 of the device housing as shown in FIGS. 1 and 2, the actuation surface 132 of the resiliently disposed post 110 forces the pivot member 120 against fulcrum 124 and (moveable) contact 122 against fixed switch contact 116. Electrical connectivity is thus established between terminals 114 and 128.

Figure 4:
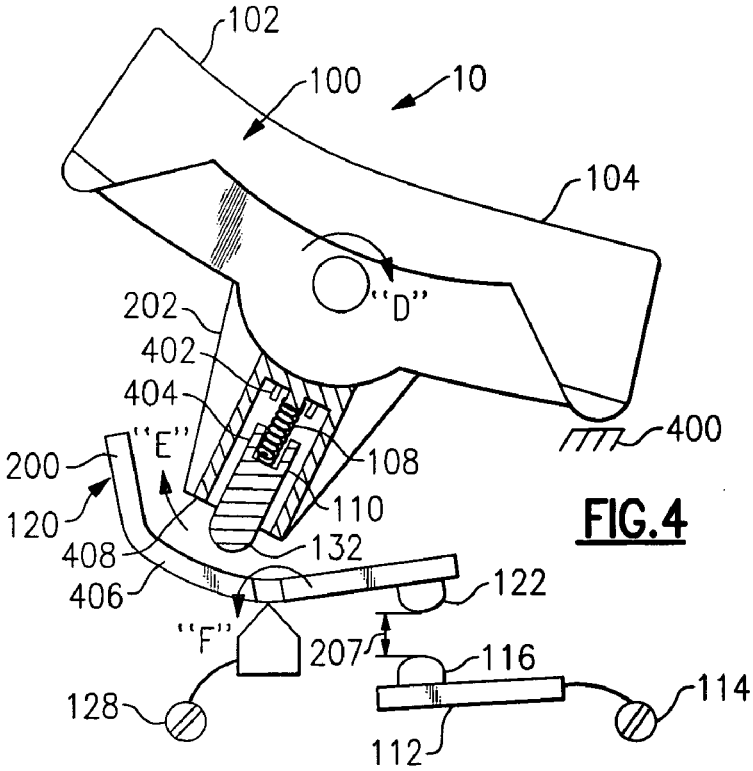

In particular, from an open contact position as illustrated in FIG. 4, switch closure is accomplished by applying force to the user accessible surface 104, which causes counterclockwise direction of the rocker assembly 100 about pivot point 106 as indicated by directional arrow A in FIG. 1. Actuation surface 132 of post 110 frictionally slides along the surface of pivot member 120 in the direction indicated by arrow B in FIG. 1 until rocker assembly 100 touches stop 130. The pressing motion of post 110 causes pivot member 120 to rotate about fulcrum 124 as indicated by directional arrow C in FIG. 1 until contact 122 strikes contact 116. The contacts momentarily separate, i.e. bounce. However, the switch assembly portion 10 is configured such that the contacts meet when the distance between surface 132 of post 110 and contact 122 is less than a distance, 2L, corresponding to about two times the longitudinal dimension, L, of contact 122. Accordingly, post surface 132 and spring 108 are situated near contact 122 to absorb the bounce energy and to preferably eliminate bounce.

Figure 3:
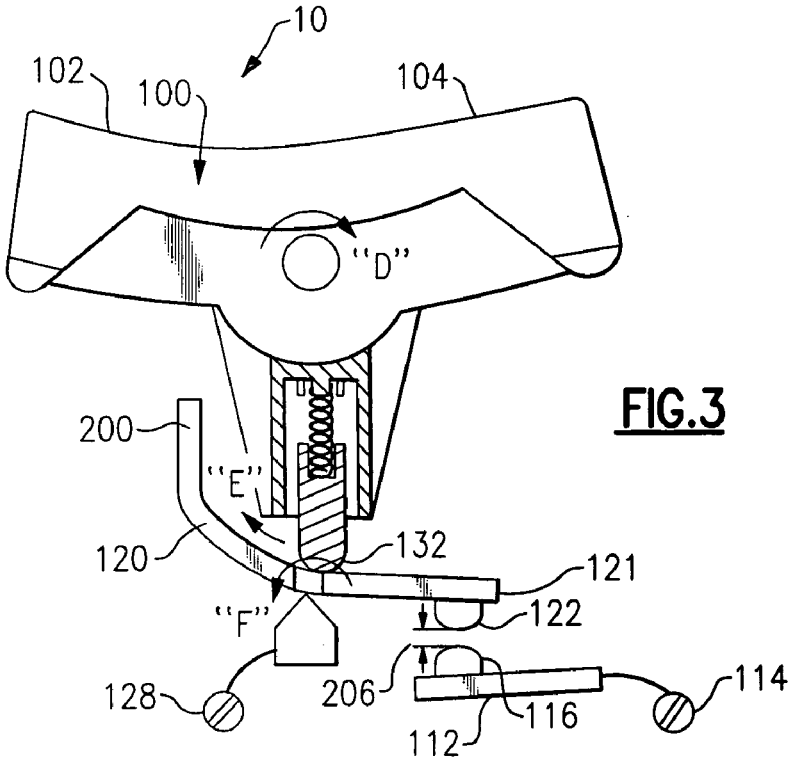

FIGS. 2 through 4 are snapshot diagrams illustrating the progressive steps of opening the switch contacts from the closed contact position of FIG. 1. As depicted in FIG. 2, upon a force being applied by a user to the elevated portion of user surface 104, rocker assembly 100 is caused to rotate about pivot 106 as denoted by directional arrow D.

As this occurs, actuation surface 132 of post 110 slides on the surface of pivot member 120 as shown by directional arrow E, prior to reaching the fulcrum 124. Therefore, post 110 continues to exert downward force on the pivot member 120 that tends to close contacts 122, 116. However, a comparatively stronger force to pivot member 120 is applied by way of user surface 104 to striking surface 202 of the rocker assembly 100, to a lever arm portion 200 on pivot member 120. The force exerted by way of lever arm portion 200 tends to start to open contacts 122, 116 at 204. Since the coupled force from lever arm portion 200 is greater than the force from the actuation surface 132 of post 110, pivot member 120 rotates in the contact opening direction as shown by directional arrow F. In other words, the contact separation is initiated by way of lever arm 200, not by post 110. In particular, contact separation is caused by a force applied to (moveable) contact 122 that is tangential (T) with respect to the mating surface of fixed contact 116. Positioning feature 126 may be configured to permit any necessary tangential motion in pivot member 122.

Although the contacts 122, 116 have separated, electrical connectivity between terminals 114 and 128 continues due to the electrical arc generated between contacts 116, 122 upon separation. For AC power distribution systems, the electrical arc persists until a subsequent zero crossing of the load current occurs. The energy of the arc is minimized if the contacts separate from each other to less than a predetermined first separation distance 206. The switch assembly 10 adheres to the predetermined distance objective even if force is abruptly applied to user surface 104. The predetermined distance is chosen that is suitable for the given source voltage and frequency of the power distribution system. In a switch embodiment intended for a 120VAC, 60 Hz electrical distribution system, for example, a first contact separation distance 206 is less than about 0.03 inches at 0.008 seconds after the contacts have started to separate. In a particular aspect, the first contact separation distance is about 0.02 in.

The force exerted against lever arm 200 by striking surface 202 and the resulting torque exerted at the contact interface will be sufficient to urge contacts 116 and 120 to separate from each other even if they are welded together. It is desirable to prevent the user from being able to tease the contacts into the closed position by applying force to user surface 104. The switch is vulnerable to reclosure due to the separation of the contacts being a small distance, as has been described. Such reclosure, under electrical load, results in excessive arcing that could result in a strong welded condition that even the lever arm 200 is incapable of breaking. The teasing problem is remedied by limiting the angle of rotation of the switch assembly 100 in which the first contact separation distance occurs, to about 5 degrees. It is improbable that the user can maintain the rocker within this angle of rotation to damage the switch contacts.

Referring now to FIG. 3, another progressive contact opening step is shown in which the contacts are no longer separating at the same rate of speed associated with the first contact separation distance. The downward force applied to the right hand region of user surface 104 has resulted in actuation surface 132 of post 110 sliding along the surface of pivot member 120 in direction E to a position approximately adjacent to (or just beyond) the location of fulcrum 124. Rocker assembly 100 and pivot member 120 have rotated in respective directions D and F such that rocker arm striking surface 202 no longer applies a force to lever arm 200 to continue separating the contacts 116, 122. Post 110 is applying a downward force on fulcrum 124 which does not result in rotation of pivot member 120 to open the switch contacts in the second manner. Thus, FIG. 3 represents a saddle point condition in which the separation between contacts 116, 122 is influenced by neither lever arm 200 nor post 110.

Now referring to FIG. 4, another progressive opening step is shown in which the switch contacts continue to open to a second contact separation distance 207. The downward force applied to user surface 104 has resulted in the actuation surface 132 of post 110 progressing along the surface of pivot member 120 in direction E to a position on a curved portion 406 of pivot arm 120 between fulcrum 124 and lever arm 200. Post 110 applies force to pivot member 120, causing the distance between contacts 116, 122 to increase to a second contact separation distance 207 that is governed by the speed that post 110 is expelled from the rocker assembly 100 by compressed spring 108. The rocker assembly 100 snaps into a stable open position. Actuation surface 132 continues to move in direction E until the rocker assembly 100 reaches a stop 400 referenced to the device housing (not shown.) The contacts thus become separated by a fully separated distance 207 that is great enough to provide reliable, tease-proof electrical disconnection. Although such separation distance would ordinarily result in electrical arc damage, this concern is allayed by the fact that the arc has already extinguished during the first contact separation distance opening step. For a 120 VAC electrical distribution system, for example, the second contact separation distance is equal to or less than about 0.06 inches. Thus as shown in FIG. 4, the contact separation is accomplished by way of actuation surface 132, not by lever arm 200. This is in contrast to FIG. 2 where the initial urging of contact separation was accomplished by way of lever arm 200, not by surface 132.

The presence of curved portion 406 intermediate the lever arm portion 200 and the contact end 121 of pivot member 120 is advantageous for several reasons. Pivot member 120 can be formed as a unitized piece from a malleable and highly conductive material, such as copper. The pivot member is able to occupy a miniature space within the wiring device. The curved portion 406 functionally assists in breaking a welded contact condition.

In an aspect, spring 108 can be configured to 'bottom out' when contacts 116, 122 are welded together and force is applied to user surface 104 to cause post surface 132 to slide into curved portion 406. Force applied to user surface 104, no longer limited by spring 108, is directly applied to surface 132. Accordingly, the force applied by surface 132 to curved portion 406 is sufficient to break the welded contacts apart from each other.

In another approach, a distal surface portion 408 of rocker arm striking surface 202 can be configured such that force applied to user surface 104 communicates force by way of distal surface 408 to curved surface 406 to force the welded contacts to break apart from each other, as illustrated in FIG. 4.

Electrical distribution circuits are configured to distribute a magnitude of current up to and including a rated current. Residential distribution circuits, for example, are typically rated to at least 15 Amperes. A switch disposed in the wiring device is needed that is configured to repeatably turn on, provide, and turn off such current. According to embodiments of the invention, the pivot member 120 has a thickness that conducts the electrical current without overheating. The given thickness renders pivot member 120 substantially inflexible to applied forces. In contrast to currently available switch cantilever arms, the ability to open and close the switch contacts does not rely on the pivot member (or another member) to substantially flex. Furthermore, a switch mechanism made up of a substantially inflexible member has been found by the inventor to be extremely desirable for a switch included with a protective device, in which the switch is required to switch the rated current of the electrical distribution system.

According to an embodiment of the invention, a protective device is disposed in the wiring device for protecting a portion of the electrical distribution system from a predetermined condition. The protective device portion occupies space that would otherwise be available to the switch. The switch assembly needs to connect and disconnect the current, but must be configured to fit within the available space at the same time.

Figure 5:
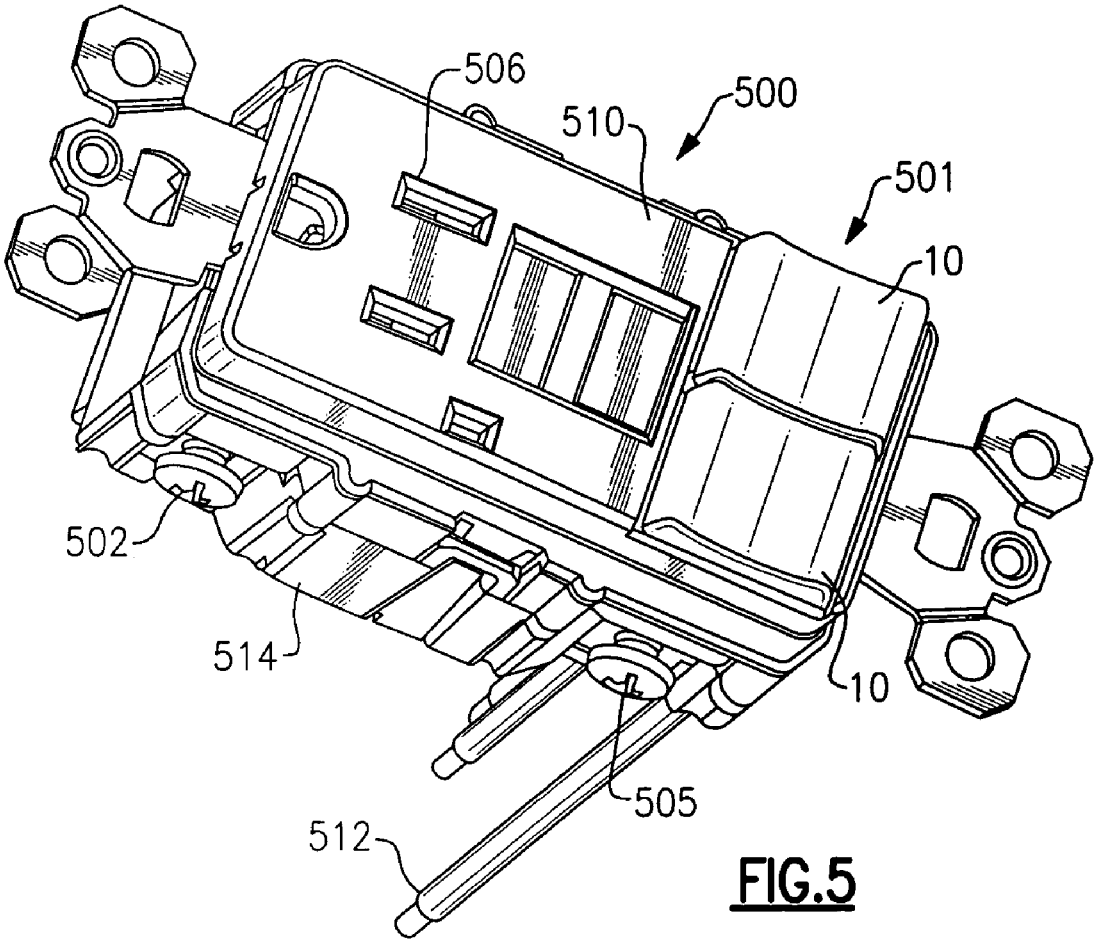
FIG. 5 is a perspective line drawing of an electrical device according to an exemplary embodiment of the invention.

Referring to FIG. 5, an exemplary wiring device 500 is shown that combines a dual, independent switch portion 501 and a protective device portion 510. Protective device portion 510 includes line terminals 502 for connection to the power source of the electrical distribution system and load terminals that include feed-through terminals 505 for connection to the protected portion of the electrical distribution system, and that may include receptacle load terminals 506 for providing protected power to a load by way of a user attachable plug. Switch portion 501 may include one or more switch assembly 10 described above. Each switch assembly 10 may include terminals (or wire leads) 512 such as have been described. The housing 514 of wiring device 500 is configured to permit the device to be disposed in the electrical distribution system. Switch portion 501 may include one or more switch subassembly portions. Terminal 114 (or alternatively terminals 128) may be a common terminal among the plurality of switches. In this manner, only one electrical conductor 518 is necessary for connecting the power source to the switch assembly. The switch assembly is able to distribute power from the one conductor by way of independently operable switches to wires 520 that in turn are connected to the switched loads.

Figure 6:
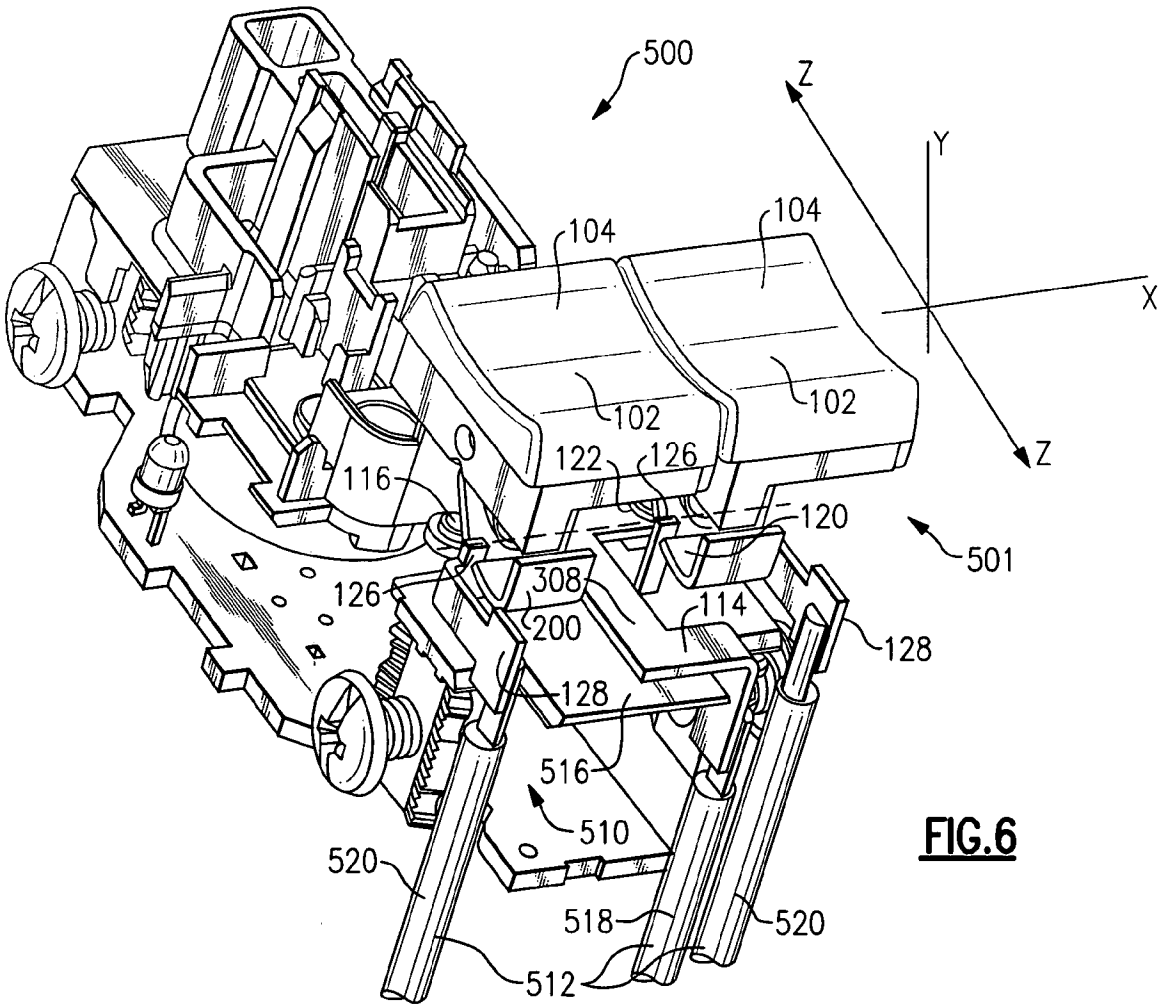
FIG. 6 is a perspective line drawing of the interior of the electrical device illustrated in FIG. 5.

FIG. 6 illustrates a partial sectional view of device 500 is shown. Switch portion 501 is limited in the height (y) dimension between barrier 516 beneath which protective device portion 510 is disposed, and user accessible surfaces 104, representing an exemplary height of about 0.60 inches. The height dimension is satisfied by disposing pivot member (s) 120 such that their length dimensions are oriented substantially parallel to the operation orientation of rockers 100, and they have a direction of motion that is substantially the same as that of rocker surfaces 104.

Figure 7:
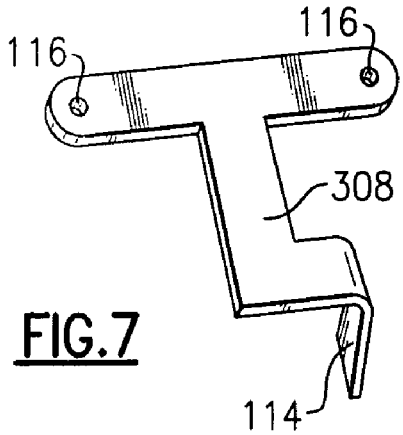
FIG. 7 is a line drawing of a common fixed contact member according to an embodiment of the invention.

As shown in FIG. 6, the fixed contact assembly 112 is in the form of a common member 308 is shown in FIG. 7. A substantially two-dimensional portion of the common member 308 has a general T-shape. Two contacts 116 are shown at respective end regions of the T-portion. In the exemplary device shown in FIG. 5, two single pole switches are disposed side by side in the device. Each switch 501 is independent of the other and includes its respective pivot assembly including pivot member 120 and load terminal 128. The common member 308, however, is referred to as such because it contains respective fixed contacts 116 for each independent switch. A portion of the common member extending from the base of the T-portion is the terminal 114, which can be connected to a power source in the electrical distribution system by the installer. The installer can choose to connect the switch to a power source by way of a line terminal or the feed-through terminal of the protection component, if provided. Thus, while the common member is always electrically hot, each load terminal 128 has power only when the respective pivot member contact 122 closes the circuit with a corresponding common contact 116.

In another approach, the device can be configured such that the compact switch assembly is internally connected to either the line terminals or the feed-through terminals of the protection component, in which case terminal 114 can be omitted. Load terminals 128 allow the installer to connect the switch assembly to one or more load, as has been described.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

We claim:

1. An electrical device configured to be disposed in an electrical distribution system including a power source for providing power to a load, including a compact switch assembly comprising:

a rocker assembly having a user accessible surface responsive to an applied force and a rocker arm member including a striking surface and an actuation surface, wherein the rocker arm member is pivotally connected to a housing portion of the device;

a fixed contact assembly having a fixed switch contact and a terminal;

a moveable contact assembly including a fulcrum member, a terminal, and a pivot member having a lever arm end and a contact end including a contact, said pivot member rotatably mounted onto the fulcrum member in response to pivoting of the rocker assembly and moveable between an open contact position and a closed contact position, wherein the applied force is coupled to the lever arm end by way of the striking surface to commence movement of the contacts from the closed contact position to the open contact position, after which applied force coupled to the contact end by way of the actuation surface continues to open the pivot member contact and the fixed contact to a predetermined distance.

2. The electrical device of claim 1, wherein the actuation surface is in constant contact with the pivot member as the pivot member is rotated between the open contact position and the closed contact position.

3. The electrical device of claim 2, wherein the actuation surface is resiliently retractable and extendable against the pivot member surface as the rocker assembly is pivoted in response to the applied force.

4. The electrical device of claim 3, wherein the rocker arm member comprises a post on which the actuation surface is disposed and a spring operatively engaged with the post, wherein the post exerts a force on the pivot member via the spring.

5. The electrical device of claim 4, wherein the post and the rocker arm member are configured to connect to opposite ends of the spring.

6. The electrical device of claim 1, wherein the pivot member has an operational direction of motion that is substantially in the same direction as the direction of the rocker assembly in response to the applied force.

7. The electrical device of claim 1 wherein the pivot member is substantially inflexible.

8. The electrical device of claim 1, wherein said pivot member contact has a longitudinal dimension, L, further wherein a distance between a point at which the actuation surface contacts the pivot member and said pivot member contact location is less than about 2 L when said pivot member is in the closed contact position.

9. The electrical device of claim 1, wherein said open contact position comprises a first contact separation distance between the contact of the pivot member and the fixed switch contact in response to the applied force coupled to the lever arm end by way of the striking surface, and a second contact separation distance between the contact of the pivot member and the fixed switch contact in response to the applied force coupled to the contact end by way of the actuation surface, wherein the second contact separation distance is greater than the first contact separation distance.

10. The electrical device of claim 9, wherein the first contact separation distance is equal to or less than about 0.03 in.

11. The electrical device of claim 10, wherein the first contact separation distance is equal to or less than about 0.02 in.

12. The electrical device of claim 9, wherein the second contact separation distance is equal to or less than about 0.04 in.

13. The electrical device of claim 9, wherein the rocker assembly pivots less than 5 degrees in rotation as the pivot member contact and the fixed contact are separated by the applied force from the closed contact position to the first separation distance.

14. The electrical device of claim 9, wherein the electrical distribution system is an alternating current system.

15. The electrical device of claim 14, wherein the pivot member is moved from the closed contact position to no greater than the first contact separation distance within an half cycle of the current to a load connected to the device.

16. The electrical device of claim 15, wherein the time is about 0.008 seconds corresponding to a 60 Hz electrical distribution system.

17. The electrical device of claim 1, wherein the pivot member contact separates from the fixed contact in a substantially tangential direction with respect to mating surfaces of the contacts.

18. The electrical device of claim 1, wherein the pivot member contact rotates against the mating surface of the fixed contact prior to separation of the contacts.

19. The electrical device of claim 1, further comprising a stop disposed within the housing, said stop being cooperatively engageable with the rocker assembly and limiting a rotational amount of motion of the rocker assembly.

20. The electrical device of claim 19, including two stops, wherein the two stops are configured such that the fixed contact and the pivot member contact move from the closed position to a predetermined open distance as the rocker assembly pivots in not greater than 5 degrees of rotation.

21. The electrical device of claim 20, wherein the predetermined distance is between about 0.02 inches to 0.03 inches.

22. The electrical device of claim 1, wherein the switch assembly has an operational current handling capacity of 15 A or greater.

23. The electrical device of claim 1, further including a circuit interrupter configured to provide power to a portion of the electrical distribution system in the closed contact position and to interrupt power from a portion of the electrical distribution system in the open contact position in response to a predetermined fault condition in the electrical distribution system.

24. The electrical device of claim 23, wherein the predetermined fault condition includes a ground fault condition.

25. The electrical device of claim 23, wherein the predetermined fault condition includes an arc fault condition.

26. The electrical device of claim 23, comprising a plurality of rocker assemblies and corresponding pluralities of pivot members and fixed contacts.

27. The electrical device of claim 26, wherein the fixed contacts are connected to a single common terminal.

28. The electrical device of claim 26, wherein each of the corresponding pluralities of rocker assemblies and pivot members are independently operable.

29. The electrical device of claim 1, comprising a plurality of rocker assemblies and corresponding pluralities of pivot members and fixed contacts.

30. The electrical device of claim 29, wherein the fixed contacts are connected to a single common terminal.

31. The electrical device of claim 29, wherein each of the corresponding pluralities of rocker assemblies and pivot members are independently operable.

32. The electrical device of claim 1, wherein the pivot member includes a curved portion adjacent the lever arm end and the positioning feature.

* * * * *